US005606145A

United States Patent [19]

Kim

[11] Patent Number: 5,606,145

[45] Date of Patent: Feb. 25, 1997

[54] CODE CHANGING METHOD FOR ELECTRONIC MUSIC INSTRUMENT WITH AUTOMATIC ACCOMPANIMENT FUNCTION AND SLUR PROCESSING

[75] Inventor: Moon K. Kim, Seoul, Rep. of Korea

[73] Assignee: LG Electronics Inc., Seoul, Rep. of Korea

[21] Appl. No.: 464,446

[22] Filed: Jun. 5, 1995

[30] Foreign Application Priority Data

Jun. 9, 1994 [KR] Rep. of Korea ..... 13027/1994

[51] Int. Cl.[6] ..... G10H 1/02; G10H 5/00

[52] U.S. Cl. ..... 84/662; 84/626

[58] Field of Search ..... 84/626, 662

[56] References Cited

U.S. PATENT DOCUMENTS 4,524,668 6/1985 Tomisawa et al. .

4,558,624 12/1985 Tomisawa et al. ..... 84/626

4,726,276 2/1988 Katoh et al. .

4,920,851 5/1990 Abe ..... 84/626

5,216,189 6/1993 Kato ..... 84/662

*Primary Examiner*—William M. Shoop, Jr.

*Assistant Examiner*—Jeffrey W. Donels

[57] ABSTRACT

An improved code changing method for an electronic musical instrument with an automatic accompaniment function allows a chord code change during a play in accordance with a tone of an musical instrument being used in the current accompaniment just before a new code representing a new chord is inputted for the next music play. The method includes judging the possibility of a slur processing by recognizing a tone being used in the automatic accompaniment when the new code information is inputted, performing the slur processing when the slur processing is judged to be possible, and performing a retriggering process or an automatic accompaniment by neglecting the new code information, when the slur processing is judged to be impossible.

18 Claims, 4 Drawing Sheets

CODE CHANGING METHOD FOR ELECTRONIC MUSIC INSTRUMENT WITH AUTOMATIC ACCOMPANIMENT FUNCTION AND SLUR PROCESSING

BACKGROUND OF THE INVENTION

1. Field of the Invention

The present invention relates to a code changing method for an electronic music instrument with an automatic accompaniment function, and in particular to an improved code changing method for an electronic music instrument with an automatic accompaniment function capable of changing a code during a play in accordance with a tone of an electronic musical instrument before a new code is inputted for the next music play.

2. Description of the Background Art

As shown in FIG. 1, a conventional electronic musical instrument with an automatic accompaniment function includes a function input circuit 101 provided for outputting a signal corresponding to an automatic accompaniment function and automatic accompaniment style which are selected by a user; a keyboard information input circuit 102 provided for inputting a signal corresponding to a keyboard information of a code, (e.g., a chord) a melody, and the like which are selected by the user; a control circuit 103 provided for performing an automatic accompaniment function in accordance with a signal outputted from the function input circuit 101 and the keyboard information input circuit 103, a sound source circuit 104 provided for processing a sound signal outputted from a previously stored sound data in accordance with a control signal outputted from the control circuit 103; and a sound output circuit 105 provided for amplifying and outputting a sound signal outputted from the sound source circuit 104.

The operation of the conventional electronic music instrument with an automatic accompaniment function will be explained with reference to FIGS. 2 and 3.

To begin with, the control circuit 103 checks a signal outputted from the function input circuit 101 and judges whether a predetermined function (i.e., an automatic accompaniment function) is selected (Step 1). As a result of the judgement of the step 1, if the automatic accompaniment function is not selected, the step 1 is repeated. However, if the automatic accompaniment function is selected, the control circuit 103 checks a signal outputted from the keyboard information input circuit 102 and judges whether a predetermined code (e.g., representing a chord) is outputted therefrom (Step 2).

As a result of the step 2, if it is determined that a predetermined code (i.e., the chord) is not inputted to the control circuit 103, the control circuit 103 repeats the second step. If the code is inputted, the control circuit 103 checks a signal outputted from the function input circuit 101 (Step 3) and performs the automatic accompaniment function (Step 4).

That is, the control circuit 103 recognizes an automatic accompaniment style selected by the user and outputs a control signal in accordance with the automatic accompaniment style recognized by the step 3.

Thereafter, the sound source circuit 104 outputs a sound signal from the previously stored sound data in accordance with the control signal, and outputs the sound signal to the sound output circuit 105.

Thereafter, the control circuit 103 checks a signal outputted from the keyboard information input circuit 102 and judges whether a new code (a new chord) for an automatic accompaniment is inputted (Step 5). As a result of the step 5, if the new code is not inputted, the steps 4 and 5 are repeated. If a new code is inputted, the control circuit 103 processes a code change in accordance with the inputted new code.

Here, the code change process is performed as follows.

That is, after a music is played in a C major as shown in FIG. 3A, if the code information (i.e., representing a chord) in F major is inputted as shown in FIG. 3B, the control circuit 103 performs an automatic accompaniment following the newly inputted code information in F major.

Meanwhile, as shown in FIG. 3A, in a state that a music of a C major is played from the starting point to the Z-point, if a code information in F major is inputted as shown in FIG. 3B, the control circuit 103 performs an automatic accompaniment in the F major after the Z-point as shown in FIG. 3C.

Here, as shown in FIG. 3D, if the new code information is inputted while a music is being played, the previous music is slurred for a soft connection between the previous music and the newly inputted music. Here, a slur processing smoothly varies a high pitch difference in sound so as to continue the previous tone play.

However, the conventional electronic musical instrument with an automatic accompaniment function has disadvantages in that when a new code information representing a chord, for example, is inputted to change a music while the music is being played, an unusual tone is generated because the conventional code processing method is directed to changing the last tone which exists when a new code representing a new chord is inputted, so that there may be another tone which is different from the currently playing music.

SUMMARY OF THE INVENTION

Accordingly, it is an object of the present invention to provide a code changing method for an electronic musical instrument with an automatic accompaniment function, which overcomes the problems encountered in the conventional code changing method for an electronic musical instrument with an automatic accompaniment function.

It is another object of the present invention to provide an improved code changing method for an electronic musical instrument with an automatic accompaniment function capable of changing a code during a play in accordance with a tone of an electronic musical instrument before a new code is inputted for the next music play.

To achieve the above objects, there is provided with a code changing method for an electronic musical instrument with an automatic accompaniment function, which includes the steps of judging a possibility of a slur processing by recognizing a tone being used in an automatic accompaniment when a new code information representing a chord is inputted during a play of an automatic accompaniment; performing an automatic accompaniment by a slur processing when the slur processing is judged as possible; and performing a retriggering process or an automatic accompaniment by neglecting the new code information being neglected when the slur processing is judged as impossible.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and, thus, are not limitative of the present invention, and wherein.

DETAILED DESCRIPTION OF THE PREFERRED EMBODIMENTS

Figure 4:
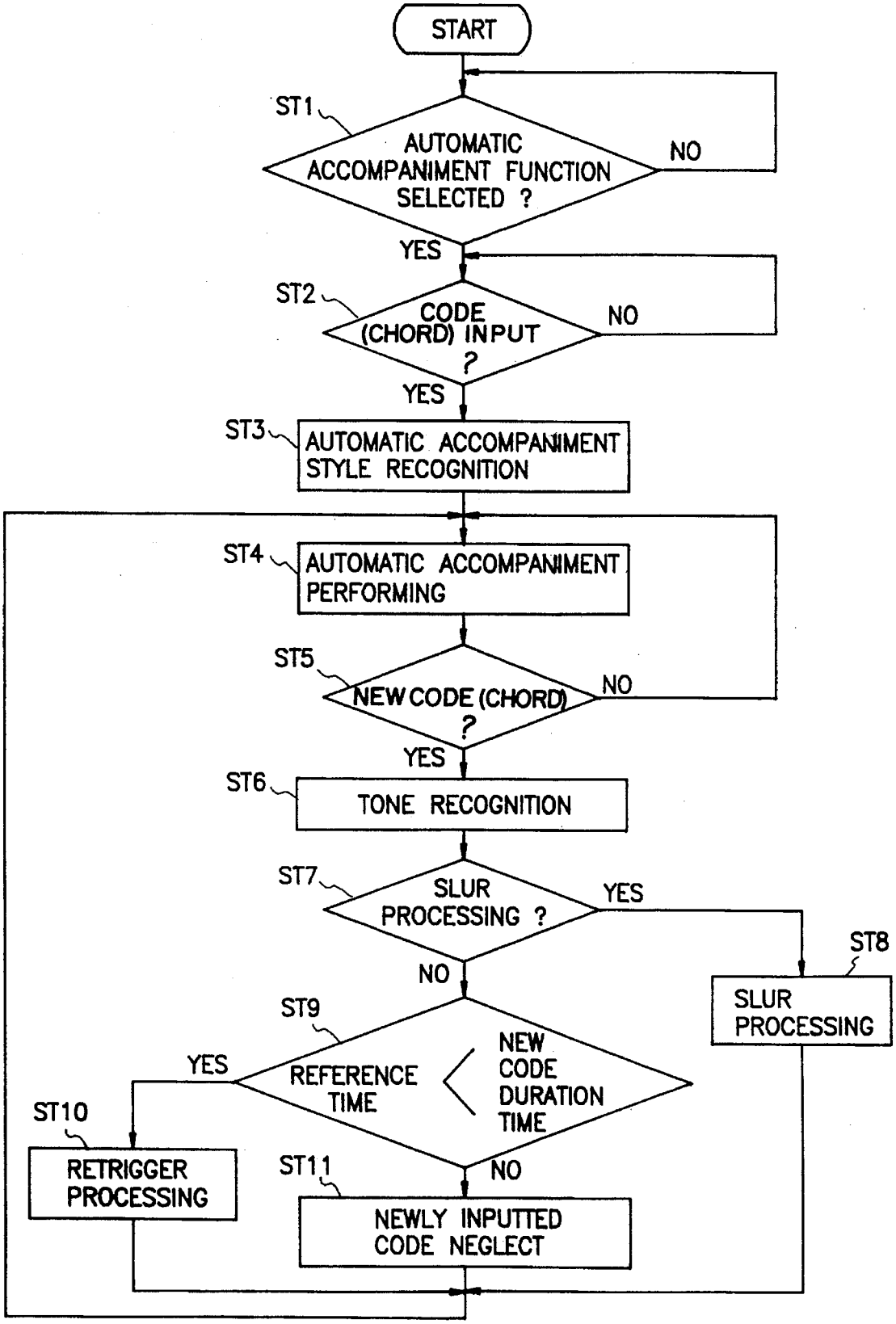
FIG. 4 is a flow chart of a code change method for an electronic musical instrument according to the embodiments of the present invention.

Referring to FIG. 4, a code changing method for an electronic musical instrument with an automatic accompaniment function according to the embodiments of the present invention includes the steps of performing an automatic accompaniment in accordance with a selected accompaniment style when a predetermined code representing a chord, for example, is inputted; judging a possibility of a slur processing by recognizing a tone being used in the automatic accompaniment when a new code information representing a new chord is inputted during a play of the automatic accompaniment; performing an automatic accompaniment by a slur processing when the slur processing is judged as possible; and performing a retriggering process or an automatic accompaniment with the new code information being neglected when the slur processing is judged as impossible.

Here, the step of performing a retriggering process or an automatic accompaniment includes the steps of judging whether a duration time of the newly inputted code information is longer than a previously set-up reference time; performing an automatic accompaniment after a retriggering process of the newly inputted code information when the duration time of the newly inputted code information is judged to be longer; and neglecting the newly inputted code information and performing an automatic accompaniment when the newly inputted code information is judged to be shorter.

Figure 1:
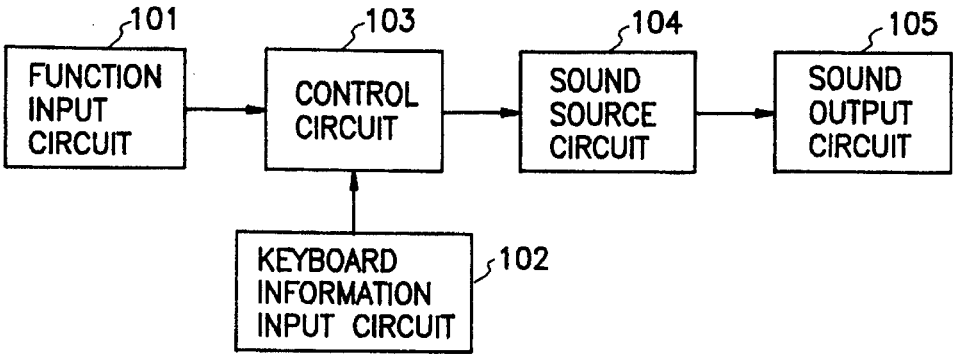
FIG. 1 CONVENTIONAL ART
FIG. 1 is a schematic block diagram of a conventional electronic musical instrument with an automatic accompaniment function.
Figure 2:
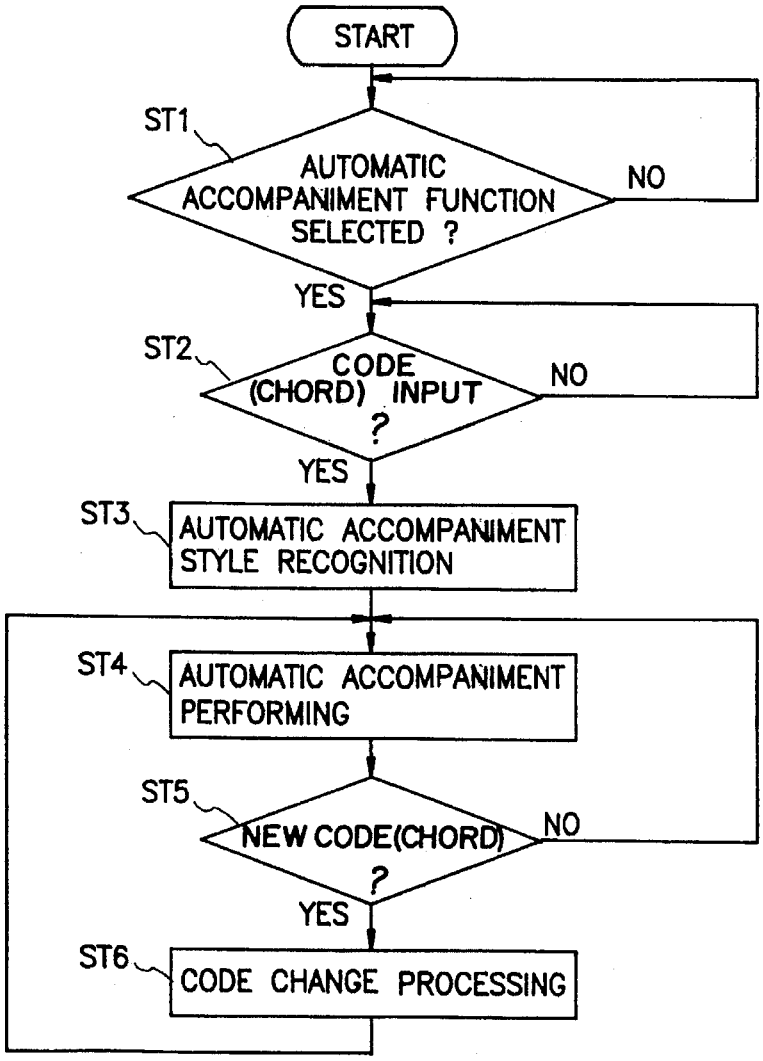
FIG. 2 CONVENTIONAL ART
FIG. 2 is a flow chart of a code change method during a code change of an automatic accompaniment in the conventional electronic musical instrument of FIG. 1.
Figure 3A:
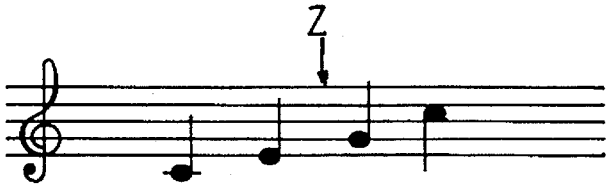
FIG.3A CONVENTIONAL ART
FIG. 3A is a musical note of one example of a code processing method of FIG. 2.
Figure 3B:
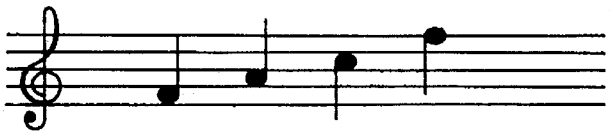
FIG.3B CONVENTIONAL ART
FIG. 3B is a musical note of one example of a code processing method of FIG. 2.
Figure 3C:
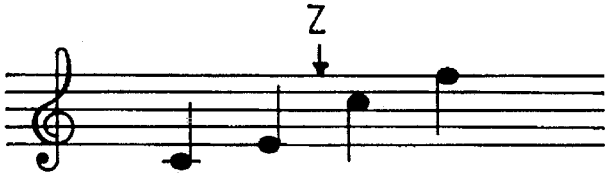
FIG.3C CONVENTIONAL ART
FIG. 3C is a musical note of one example of a code processing method of FIG. 2.
Figure 3D:
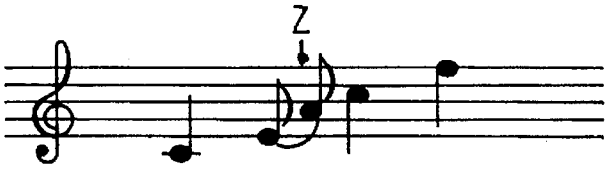
FIG.3D CONVENTIONAL ART
FIG. 3D is a musical note of one example of a code processing method of FIG. 2.

The operation of the code changing method for an electronic music instrument with an automatic accompaniment function according to the embodiments of the present invention will now be explained with reference to FIGS. 1, 5 and 6. FIG. 1 illustrates components used to carry out the code changing method of the present invention.

To begin with, the control circuit 103 checks a signal outputted from the function input circuit 101 and judges whether an automatic accompaniment function is selected (Step 1).

As a result of the step 1, if the automatic accompaniment function is not selected, the control circuit 103 performs the step 1 again. However, if the automatic accompaniment function is selected, the controls circuit 103 checks an input signal outputted from the keyboard information input circuit 102 (Step 2).

As a result of the step 2, if it is determined that a code information representing a chord is not inputted, the step 2 is performed again. In case that the code information is inputted, the control circuit 103 checks a signal outputted from the function input circuit 101, recognizes an automatic accompaniment style according to the signal (Step 3), and performs an automatic accompaniment function in accordance with the recognition (Step 4).

Thereafter, the control circuit 103 checks the signal outputted from the keyboard information input circuit 102 and judges whether a predetermined new code information representing a new chord is inputted (Step 5). As a result of the step 5, if the new code is not inputted, the steps 4 and 5 are repeated. If the new code is inputted, the control circuit 103 performs a code change in accordance with the newly inputted code information.

The above code changing method will now be explained in detail.

To begin with, the control circuit 103 stores three kinds of information each representing a typical musical instrument. That is, there are stored characteristics of a musical instrument which is capable of slurring notes such as a trumpet or a guitar and characteristics of a musical instrument which is not capable of slurring notes, such as a bell.

Thereafter, the control circuit 103 recognizes a tone of an instrument used in the current automatic accompaniment (Step 6), and compares this tone information obtained in the step 6 with the tone information previously stored in the control circuit 10 (Step 7). That is, if the tone of the instrument used in the current automatic accompaniment is one capable of slurring according to the stored characteristics of musical instruments, a slur processing is determined to be possible.

Figure 5A:
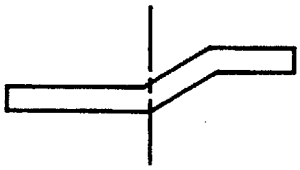
FIG. 5A is a view for explaining the code change processing method of FIG. 4 according to the present invention.

As a result of the judgement in the step 7, if it is determined that a slur processing is possible, the steps 4 through 7 are performed after performing the slurring processing of the notes played just before the new code information is inputted as shown in FIG. 5A.

Figure 5B:
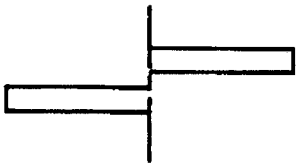
FIG. 5B is a view for explaining the code change processing method of FIG. 4 according to the present invention.

Meanwhile, as a result of the judgement in the step 7, if it is determined that slur processing is impossible, the control circuit 103 judges whether the duration time of the newly inputted code (i.e., a duration of a chord) is longer than the previously set-up reference time (Step 9). As a result of the judgement in the step 9, if it is determined that the duration time of the newly inputted code information is longer, a retriggering process is performed as shown in FIG. 5B. That is, retriggering means that the control circuit 103 performs a note-off, of the note which is being played just before the new code information is inputted and then the control circuit 103 performs a note-on of the note corresponding to the newly inputted chord. Then the steps 4 through 9 are performed. Therefore, retriggering does not involve a slurring processing.

Figure 6:
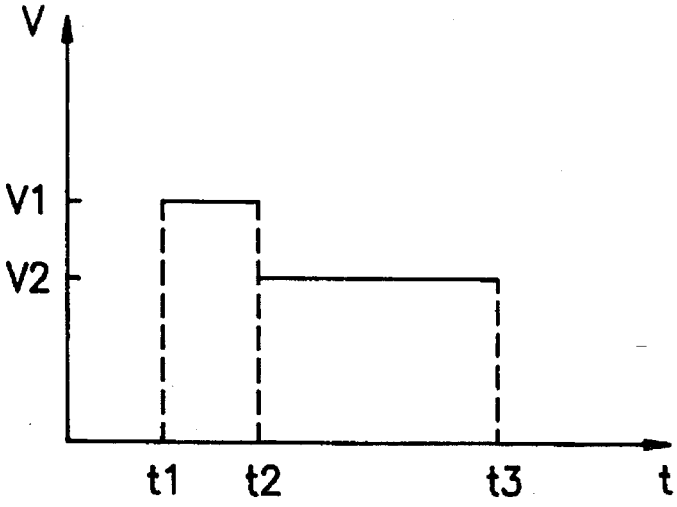
FIG. 6 is an exemplary view of a graph of a tone force retriggered at the time of a retrigger processing of FIG. 4. according to the present invention.

Here, as shown in FIG. 6, if a tone force V2 at the time of a note-on is the same as a tone force V1 corresponding to a music which is being played just before a new code information is inputted, the music becomes unusual because a code change is neglected. An automatic accompaniment is performed on the basis of the tone force V2 which is obtained by the following formula (1).

$$V2 = \frac{t2 - t1}{t3 - t1} \times V1 \quad (1)$$

where, t3–t1 is a tone duration time when a code is not changed, and t2 is a time when a code change starts.

Figure 5C:
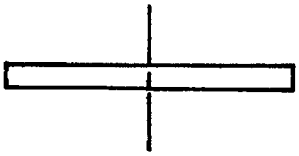
FIG. 5C is a view for explaining the code change method of FIG. 4 according to the present invention.

Meanwhile, as a result of the step 9, if it is determined that the duration time of the newly inputted code information is shorter than a previously stored reference time, the newly inputted code information, as shown in FIG. 5C, is neglected, and then the steps 4 through 9 are performed with a previous code information.

As described above, a code change method for an electronic musical instrument with an automatic accompaniment function according to the present invention is directed to provide an improved code change method of advantageously slurring a tone when changing a music being played by recognizing a tone corresponding to a music just before being interrupted by a newly inputted code information. In addition, in case that it is difficult to slur the notes effectively, the present invention is directed to retrigger the notes in accordance with a duration time of a changed code or to perform an automatic accompaniment by neglecting the newly inputted code information, thereby to prevent a unusually slurred tone of music.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A code changing method for an electronic musical instrument with an automatic accompaniment function, comprising the steps of:

judging a possibility of a slur processing by recognizing a tone being used in a current automatic accompaniment when a new code information including a chord information is inputted during a play of the current automatic accompaniment;

continuing the automatic accompaniment using a slur processing when the slur processing is judged to be possible in the judging step; and performing a retriggering process or the automatic accompaniment with the new code information neglected when the slur processing is judged to be impossible in the judging step.

2. A method of claim 1, wherein said step of performing the retriggering process or the automatic accompaniment includes the steps of:

judging whether a duration time of the new code information is longer than a reference time;

performing the automatic accompaniment after performing the retriggering process of the new code information when the duration time of the new code information is judged to be longer; and performing the automatic accompaniment including neglecting the new code information when the new code information is judged to be shorter.

3. A method of claim 1, wherein said retriggering process includes the steps of:

performing a note-off operation of a note being played just before the new code information is inputted, and performing a note-on operation of a note corresponding to the new code information.

4. A method of claim 1, wherein said judging step includes the steps of:

storing characteristics of musical instruments which are capable of performing a slur processing, storing characteristics of other musical instruments which are incapable of performing a slur processing, and comparing the tone being used in the current automatic accompaniment with the stored characteristics of musical instruments to determine the possibility of the slur processing.

5. A method of performing an automatic accompaniment in an electronic musical device, comprising the steps of:

performing an automatic accompaniment according to a first code representing a first chord inputted to the musical device when an automatic accompaniment function is selected;

detecting an input of a second code representing a second chord to the musical device;

determining whether a slur processing is possible if the input of the second code is detected; and performing the slur processing or one of a retriggering process and a code neglecting process based on said determination.

6. A method of claim 5, wherein the step of performing an automatic accompaniment includes the step of:

recognizing a style of the automatic accompaniment based on the first code inputted.

7. A method of claim 5, wherein the step of determining whether a slur processing is possible includes the step of:

recognizing a tone of music being played in the automatic accompaniment prior to the input of the second code.

8. A method of claim 7, wherein the step of recognizing includes the steps of:

storing characteristics of musical instruments which are capable of slurring and characteristics of other musical instruments which are incapable of slurring, and comparing the tone of music with the stored characteristics of musical instruments to determine whether the slur processing is possible.

9. A method of claim 7, wherein the step of performing one of a retriggering process and a code neglecting process includes the steps of:

comparing a duration time of the second code with a predetermined time, and performing the retriggering processing if the duration time is longer than the predetermined time.

10. A method of claim 9, wherein the retriggering processing includes the steps of:

performing a note-off operation of a note being played just before the second code is inputted, and performing a note-one operation of a note corresponding to the second code.

11. A method of claim 9, wherein the code neglecting processing is performed if the duration time of the second code is shorter than the predetermined time, and the code neglecting processing includes the steps of:

neglecting the second code, and continuing the automatic accompaniment according to the first code.

12. A code changing apparatus for an electronic musical instrument with an automatic accompaniment function, comprising:

control means for judging a possibility of a slur processing by recognizing a tone being used in a current automatic accompaniment when a new code information including a chord information is inputted thereto during a play of the current automatic accompaniment; and accompaniment means for performing the slur processing when the slur processing is judged to be possible, and performing a retriggering process or the automatic accompaniment with the new code information neglected when the slur processing is judged to be impossible.

13. An apparatus of claim 12, wherein the control means compares a duration time of the new code information with a reference time to determine whether to perform the retriggering process or the automatic accompaniment with the new code information being neglected.

14. An apparatus of claim 12, wherein the retriggering process includes a note-off operation of a note being played just before the new code information is inputted, and a note-on operation of a note corresponding to the new code information.

15. An apparatus of claim 12, wherein the control means stores characteristics of musical instruments which are capable of performing a slur processing, stores characteristics of other musical instruments which are incapable of performing a slur processing, and compares the tone being used in the current automatic accompaniment with the stored characteristics of musical instruments to determine the possibility of the slur processing.

16. An apparatus of claim 13, wherein the retriggering process is performed when the duration time of the new code information is determined to be longer than the reference time.

17. An apparatus of claim 13, wherein the automatic accompaniment with the new code information being neglected is performed when the duration time of the new code information is determined to be shorter than the reference time.

18. An apparatus of claim 16, wherein the automatic accompaniment with the new code information being neglected is performed when the duration time of the new code information is determined to be shorter than the reference time.

* * * * *